US010264849B2

(12) United States Patent
Naemi et al.

(10) Patent No.: US 10,264,849 B2
(45) Date of Patent: Apr. 23, 2019

(54) FOOTWEAR

(71) Applicant: STAFFORDSHIRE UNIVERSITY, Stoke-on-Trent (GB)

(72) Inventors: Roozbeh Naemi, Stoke-on-Trent (GB); Nachiappan Chockalingam, Stoke-on-Trent (GB); Panagiotis Chatzistergos, Stoke-on-Trent (GB)

(73) Assignee: STAFFORDSHIRE UNIVERSITY, Stoke—on—Trent (GB)

( * ) Notice: Subject to any disclaimer, the term of this patent is extended or adjusted under 35 U.S.C. 154(b) by 119 days.

(21) Appl. No.: 15/127,020

(22) PCT Filed: Mar. 17, 2015

(86) PCT No.: PCT/GB2015/050783
§ 371 (c)(1),
(2) Date: Sep. 17, 2016

(87) PCT Pub. No.: WO2015/140542
PCT Pub. Date: Sep. 24, 2015

(65) Prior Publication Data

US 2017/0105481 A1 Apr. 20, 2017

(30) Foreign Application Priority Data

Mar. 18, 2014 (GB) ..... 1404795.5

(51) Int. Cl.
*A43B 13/18* (2006.01)
*A43B 13/12* (2006.01)
(Continued)

(52) U.S. Cl.
CPC ..... *A43B 13/186* (2013.01); *A43B 5/06* (2013.01); *A43B 13/04* (2013.01); *A43B 13/125* (2013.01);
(Continued)

(58) Field of Classification Search
CPC ..... A43B 13/186; A43B 13/04; A43B 13/125; A43B 13/127; A43B 13/14; A43B 13/18; A43B 13/188
(Continued)

(56) References Cited

U.S. PATENT DOCUMENTS 2,968,105 A * 1/1961 Rizzo ..... A43B 13/20 36/29
4,934,070 A * 6/1990 Mauger ..... A43B 1/0045 36/25 R
(Continued)

FOREIGN PATENT DOCUMENTS

EP 0629360 A1 12/1994
EP 1402795 A1 3/2004
(Continued)

OTHER PUBLICATIONS

UK Search Report dated Mar. 31, 2015 for Patent Application No. GB1404795.5.
(Continued)

*Primary Examiner* — Ted Kavanaugh
(74) *Attorney, Agent, or Firm* — Moser Taboada

(57) ABSTRACT

An item of footwear including a sole assembly that comprises at least an outsole and an insole, and further comprising one or more shear force-reducing coupling elements (30) disposed between the insole and the ground. The coupling elements (30) are adapted to permit limited displacement, in a plane parallel, in use, to the ground, of overlying components of the item of footwear. The coupling elements (30) provide less resistance to displacement of overlying components of the item of footwear in a first direction than in a second, reverse direction.

21 Claims, 5 Drawing Sheets

(51) Int. Cl.
*A43B 13/14* (2006.01)
*A43B 5/06* (2006.01)
*A43B 13/04* (2006.01)

(52) U.S. Cl.
CPC ..... *A43B 13/127* (2013.01); *A43B 13/14* (2013.01); *A43B 13/141* (2013.01); *A43B 13/18* (2013.01); *A43B 13/188* (2013.01)

(58) Field of Classification Search
USPC ..... 36/28, 29, 7.8
See application file for complete search history.

(56) References Cited

U.S. PATENT DOCUMENTS 4,955,147 A * 9/1990 Bos ..... A43B 3/0005 36/11.5
5,469,638 A 11/1995 Crawford, III
5,768,806 A * 6/1998 Parisotto ..... A43B 21/26 36/102
5,822,886 A * 10/1998 Luthi ..... A43B 13/181 36/28
6,044,577 A 4/2000 Clark
6,061,928 A 5/2000 Nichols
6,115,945 A 9/2000 Ellis, III
6,131,310 A * 10/2000 Fang ..... A43B 1/0009 36/28
6,389,713 B1 5/2002 Kita
6,625,905 B2 9/2003 Kita
6,675,500 B1 1/2004 Cadamuro
6,769,202 B1 8/2004 Luthi et al.
6,925,732 B1 8/2005 Clarke
7,401,419 B2 7/2008 Lucas et al.
7,543,399 B2 6/2009 Berend et al.
7,827,703 B2 11/2010 Geer et al.
7,886,461 B2 2/2011 Sato
7,950,168 B2 5/2011 Nakano
7,992,324 B2 8/2011 Lacorazza et al.
8,291,614 B2 10/2012 Ellis, III
2001/0025432 A1 10/2001 Contreras et al.
2001/0027615 A1 10/2001 Nasako et al.
2003/0005600 A1 1/2003 Kita
2004/0168354 A1 9/2004 Nguyen
2004/0187350 A1 9/2004 Lacorazza et al.
2005/0050770 A1 3/2005 Gyr
2005/0089675 A1 4/2005 Christiansen
2005/0108898 A1 5/2005 Jeppesen et al.
2005/0126042 A1 6/2005 Baier et al.
2005/0193589 A1* 9/2005 Bann ..... A43B 13/181 36/28
2006/0191162 A1 8/2006 Aveni et al.
2008/0022562 A1 1/2008 Manis
2009/0151199 A1 6/2009 Connor
2009/0241377 A1 10/2009 Kita et al.
2010/0192415 A1 8/2010 James
2010/0205831 A1 8/2010 Cheskin et al.
2011/0197470 A1 8/2011 Caron et al.
2011/0203140 A1 8/2011 Robinson, Jr. et al.
2011/0296717 A1 12/2011 Park et al.
2012/0057930 A1 3/2012 Rastegar et al.
2012/0227289 A1 9/2012 Beers et al.
2013/0125419 A1 5/2013 Smith et al.
2013/0125421 A1 5/2013 Stegmaier et al.
2013/0205620 A1 8/2013 Hsu
2013/0247415 A1 9/2013 Kohatsu

FOREIGN PATENT DOCUMENTS

EP 1582658 A2 10/2005
EP 2316293 A1 5/2011
WO WO-9428750 A1 12/1994
WO WO-2010020019 A1 2/2010

OTHER PUBLICATIONS

International Search Report and Written Opinion dated Jul. 6, 2015 for PCT Application No. PCT/GB2015/050783.
International Preliminary Report on Patentability dated Sep. 20, 2016 for PCT/GB2015/050783.

* cited by examiner

FOOTWEAR

This invention relates to improvements in footwear, and in particular to footwear adapted to reduce shear forces applied to the wearer's foot.

All shoes incorporate a sole and an upper. The sole is the ground-contacting bottom component of the shoe, and the upper holds the shoe onto the foot. The sole may comprise a single layer of material, possibly of leather but more commonly in modern footwear of man-made material, or the sole may have several layers, again most commonly constructed of synthetic materials. Multilayer soles are particularly common in shoes intended for use in strenuous activities, for instance running shoes or shoes adapted for use in other sports or physical activities, or in shoes for wearers with medical problems that could potentially be exacerbated by the repetitive application of pressure to the foot, eg diabetic patients with a susceptibility to the development of foot ulcers.

Multilayer soles may consist of an outsole, a midsole and an insole.

The outsole is the ground-contacting layer of the sole and is usually constructed of a durable and less compliant material. It may comprise a single component or an assembly of different components of different materials. Rubber or rubber-like materials are often used for durability and traction, which may be further improved by forming the outsole with a textured external profile, eg with ridges or studs.

The insole lies directly beneath the wearer's foot. It may be physically joined to the underlying layers of the sole or it may be a separate component. The insole often incorporates cushioning components and may be shaped to counteract problems due to defects in the shape of the foot or to affect the positioning of the foot.

The midsole lies between the insole and outsole. Whilst many shoes may not include a midsole, it is generally an important component of shoes for which shock absorption is important, eg running shoes and other sports shoes. In such cases, the midsole commonly includes components and materials that provide cushioning, by absorbing forces experienced during physical activity. In the case of a running shoe, for instance, the midsole may contain compressible gas-filled compartments, gel or foam materials. These are compressed when the shoe strikes the ground (most commonly during "heelstrike", where it is the heel part of the shoe that takes most of the impact) and when the wearer pushes off from the ground at the commencement of the next stride ("toe-off").

It has long been realised that the repeated forces experienced during activities such as running, particularly on hard and inelastic surfaces such as tarmac roads, lead to fatigue and increased risk of injury. There have therefore been considerable advances in shoe technology, aimed at providing increased cushioning and reduction of the forces experienced by a runner, essentially along the vertical axis, ie the axis perpendicular to the ground.

More recently, it has been realised that in addition to forces acting in the vertical direction, shear forces applied to the foot, ie forces acting essentially in the plane of the foot, are also significant. Shear forces on the foot plantar soft tissue may contribute to a number of pathological and non-pathological problems such as blisters and ulcers. Sufferers from certain medical conditions such as diabetes may be particularly susceptible to such problems. As a result, insole designs have been developed in an attempt to mitigate the effects of shear forces. However, these have been of limited benefit, as the upper of the shoe prevents free movement of the foot, and this results in high frictional forces being applied to the dorsal aspect of the foot (ie the instep).

Other types of footwear specifically for those with medical conditions such as diabetes include footwear with soles of increased thickness ("extra-depth soles") and so-called "rocker soles", which are also thicker than normal soles and have a rounded heel. Rocker soles function principally by decreasing pressure on the forefoot.

Despite these developments, there remains a need for footwear that overcomes or mitigates the above-mentioned and/or other disadvantages of the prior art.

According to a first aspect of the invention, there is provided an item of footwear including a sole assembly that comprises at least an outsole and an insole, and further comprising one or more shear force-reducing coupling elements disposed between the insole and the ground, the coupling elements being adapted to permit limited displacement, in a plane parallel, in use, to the ground, of overlying components of the item of footwear, and wherein the coupling elements provide less resistance to displacement of overlying components of the item of footwear in a first direction than in a second, reverse direction.

In some embodiments of the invention, the coupling elements are incorporated into a midsole that comprises upper and lower members that, in use, lie adjacent an insole and an outsole respectively. Thus, according to a further aspect of the invention, there is provided a midsole for an article of footwear, the midsole comprising upper and lower members that, in use, lie adjacent an insole and an outsole respectively, the upper and lower members being spaced apart and connected by one or more coupling elements, the one or more coupling elements being adapted to permit limited displacement, in a plane parallel, in use, to the ground, of the upper member relative to the lower member, and wherein the coupling elements provide less resistance to displacement of the upper member in a first direction than in a second, reverse direction.

The invention further provides an item of footwear having a sole assembly that comprises an insole, an outsole, and a midsole that comprises upper and lower members that, in use, lie adjacent an insole and an outsole respectively, the upper and lower members being spaced apart and connected by one or more coupling elements, the one or more coupling elements being adapted to permit limited displacement, in a plane parallel, in use, to the ground, of the upper member relative to the lower member, and wherein the coupling elements provide less resistance to displacement of the upper member in a first direction than in a second, reverse direction.

In other embodiments, the one or more coupling elements may be incorporated into the outsole, and may, in use, be in direct contact with the ground. In general, the one or more coupling elements may be located in any plane between the ground-contacting surface of the footwear and the insole. Thus, the coupling elements may form part of the outsole or of the midsole. The coupling elements permit horizontal displacement of overlying components of the footwear (ie components that in normal use of the footwear are positioned above the coupling elements) relative to the underlying component(s) and/or the ground. In most instances, this means that the coupling element is capable of a degree of flexion sufficient to permit the upper part of the coupling element to be horizontally displaced relative to the lower part.

The footwear according to the invention is advantageous primarily in that it reduces the forces applied to the plantar soft tissue of the foot. Without wishing to be bound by any theory, it is believed that this is brought about by the limited displacement of the overlying components of the footwear, ie in the case of the midsole of the invention limited displacement of the upper member of the midsole relative to the lower member. As a result of that displacement, the horizontal impulse (change of linear momentum in the direction of travel) caused by, for instance, the impact between the foot and the ground is distributed over a longer period of time. Since the impulse is essentially the product of force and time, increasing the duration of the action lessens the horizontal force experienced by the wearer of the footwear.

Moreover, the insole and the upper of the shoe are able to move together without the insole moving relative to the upper, with the result that the foot does not move relative to the insole or the upper, and so frictional/shear forces applied to the foot are substantially reduced.

The coupling elements permit displacement of the overlying components relative to the outsole or the ground, and moreover provide less resistance to movement in a first direction than in a second, reverse direction. In other words, the coupling elements are adapted to preferentially permit movement in one direction and to resist movement in the opposite direction.

Where the coupling elements are incorporated in a midsole according to the invention, between an upper member and a lower member, all the coupling elements of the midsole may be arranged in such a way that they favour displacement of the upper member in the same direction. More commonly, however, coupling elements may be disposed in different regions of the midsole and the coupling elements in different regions are configured to permit movement of the upper member in different directions.

For instance, in the case of a running shoe, it will be generally desirable for coupling elements to be arranged at the heel portion of the midsole and at the forefoot (toe) portion.

The coupling elements at the heel portion diminish shear forces generated during heelstrike. In order to achieve that effect, the coupling elements are configured to permit movement of the upper member forwards relative to the lower member. When the heel of the shoe impacts the ground, the forward movement of the upper member increases the duration of the action, so diminishing the force experienced by the runner.

The coupling elements at the forefoot portion serve to reduce the forces experienced during toe-off. In this case, the coupling elements are configured to permit backwards displacement of the upper member as the runner presses down and backwards against the ground to propel himself forwards.

For other applications, coupling elements may be arranged at regions other than the heel and forefoot portions of the midsole. For example, coupling elements may be arranged to permit lateral displacement of the upper member in shoes designed for activities such as tennis that involve repeated side-to-side movement. In another alternative, coupling elements at the forefoot may be configured to permit forwards displacement of the upper member (ie the opposite effect to that utilised in a running shoe) in shoes intended for use in activities involving abrupt stops in forwards movement on the forefoot area including, by way of example and without limitation, netball and basketball. In another example, a specific relative rotational movement during twisting over the heel or forefoot may be facilitated by arranging the elements over a circular area.

It will be appreciated that, where the coupling elements are not incorporated into a midsole, but instead are positioned, for instance, between the outsole and the ground, the effect of the coupling elements will be similar to that described above in relation to coupling elements that form part of a midsole, ie limited displacement of the overlying components of the footwear is permitted, relative to the ground, the resistance to displacement in a first direction being less than the resistance to displacement in a second, reverse direction.

The coupling elements may take any of numerous forms. In certain embodiments, the coupling elements comprise blocks of rubber or other elastomeric material that deform more readily in one direction than in the opposite direction. That directionality may be attributable to the form of the block itself; for instance, it may be a consequence of the shape of the block. Alternatively, it may be a result of the interaction of the block with another component that inhibits deformation of the block in one direction. In another alternative, such a component may be formed integrally with the block.

In other embodiments, the coupling elements may comprise inelastic materials but may be configured in such a way that they exhibit resilient deformation in the desired direction. For instance, the coupling element may incorporate a spring-like member that is adapted to deform to a greater extent in response to a force applied in one direction than to a force applied in the opposite direction.

The midsole and footwear according to the invention may be manufactured from any suitable materials and by any suitable methods. Suitable materials include many materials conventionally used in the manufacture of components for footwear. For instance, the upper and lower members of the midsole may be produced from sheets of synthetic plastics materials, eg sheets of relatively high density foam material or sheets of bonded non-woven material. Composite structures may include combinations of such materials.

The upper and lower members of the midsole according to the invention most commonly have thicknesses of between 2 mm and 5 mm. Typically, the midsole will have an overall thickness of between 3 mm and 20 mm, more commonly between 3 mm and 15 mm, eg between 5 mm and 12 mm.

In addition to its effect in reducing shear forces exerted upon the soft tissues of the foot, the footwear of the invention may also contribute to the reduction of forces experienced in the vertical direction, ie to cushioning. As such, the footwear may contribute to reduced fatigue, greater comfort, improved athletic performance and/or reduced risk of injury, eg injury to the Achilles tendon, ankle, knee or hip joints.

Thus, in preferred embodiments of the invention, the movement of the overlying components relative to the outsole or ground (eg movement of the upper member of a midsole relative to the lower member) is not entirely in the horizontal plane (plane parallel to the ground). Rather, the relative movement is in both horizontal and vertical directions. In the case of heelstrike, this allows movement of the rear-foot both downwards and forwards, while deceleration occurs in both directions. Thus, the centre of the heel bone (calcaneous) decelerates along an oblique trajectory.

The item of footwear according to the invention may be a sports shoe, eg a running shoe or a shoe designed for use in another form of sport, such as basketball, tennis or other racquet sports, or football (soccer). The item of footwear may alternatively be a shoe or boot for other outdoor pursuits, such as hiking. The footwear may also be a shoe intended for everyday use by patients suffering from, or susceptible to, trauma of the soft tissues of the foot.

Embodiments of the invention will now be described in greater detail, by way of illustration only, with reference to the accompanying drawings, in which FIG. 1 is a schematic perspective view of a first embodiment of a midsole for a shoe in accordance with the present invention;

Figure 1:
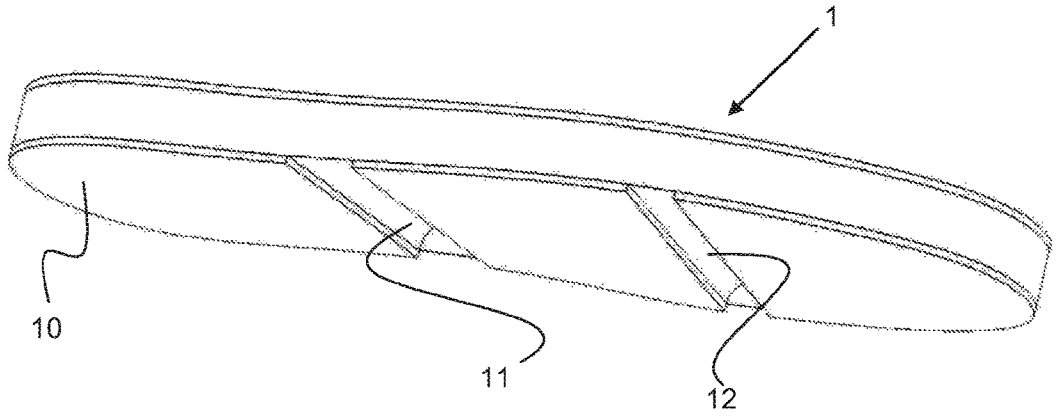
Figure 2:
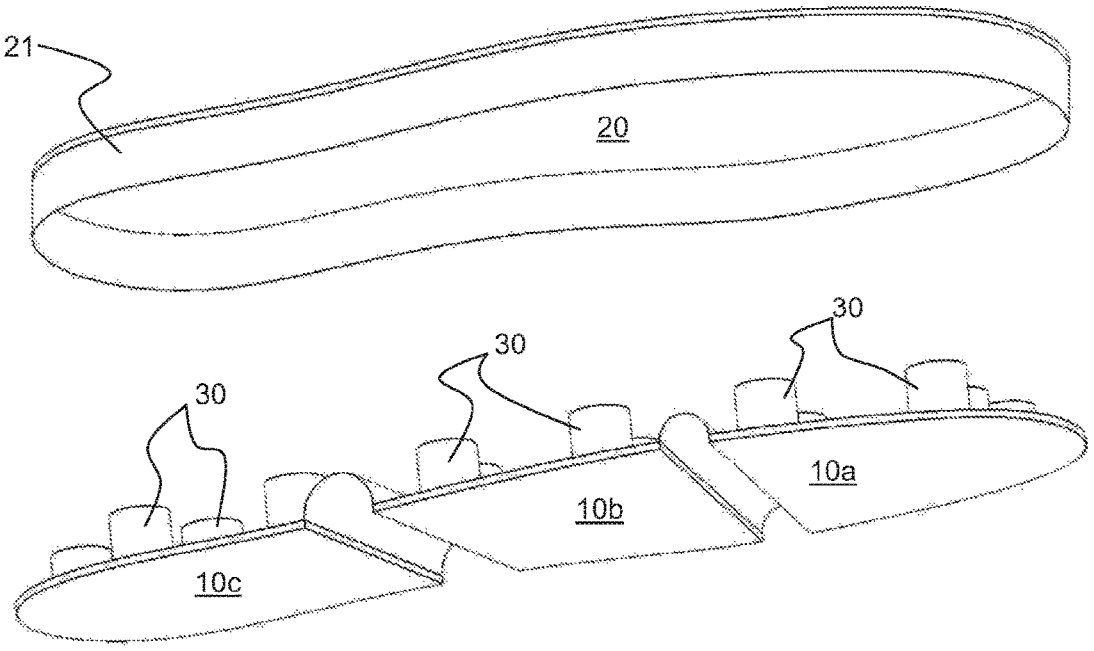
FIG. 2 shows an exploded view of the midsole of FIG. 1.
Figure 3:
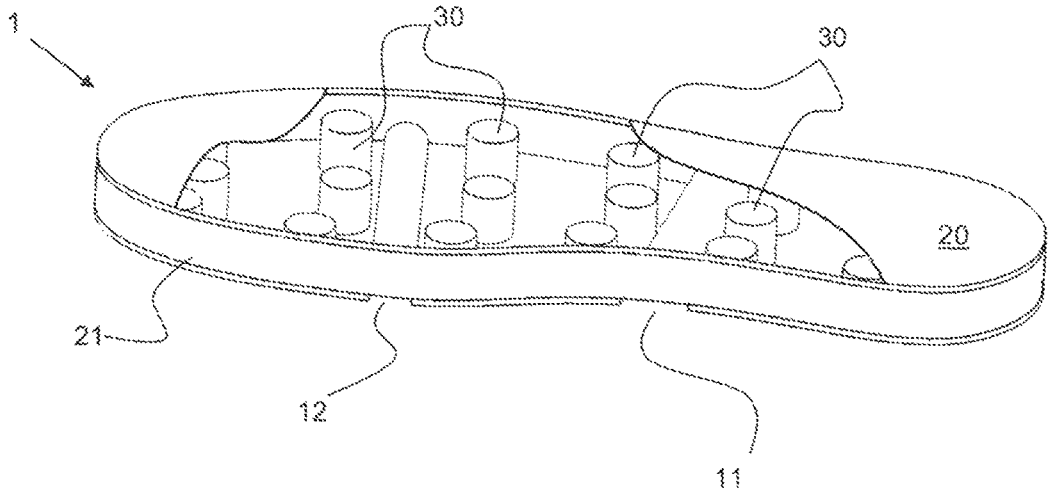
FIG. 3 is a perspective view from above of the midsole of FIGS. 1 and 2, partially cut away.

Referring first to FIGS. 1 to 3, a midsole according to the invention is generally designated 1 and comprises a baseplate 10 and top plate 20 that are of uniform extent and are spaced apart. A stretchable side wall 21 depends downwardly from the perimeter of the top plate 20 and is bonded at its lower edge to the perimeter of the baseplate 10. The baseplate 10, wall 21 and top plate 20 thus form an enclosure.

The baseplate 10 is formed with two generally transverse channels 11,12 that divide the baseplate 10 into forefoot, midfoot and heel portions (10*a*,10*b*,10*c* respectively—see FIG. 2). The channels 11,12 increase the flexibility of the baseplate 10, and hence of the midsole 1 generally, by permitting a limited degree of hinged movement. The channels 11,12 also play a part in permitting the relative movement of the top plate 20 and baseplate 10 in accordance with the invention, as explained below.

The baseplate 10 and top plate 20 may be formed of any of a wide range of suitable materials, and may be of the same or different materials. Most commonly, such materials will be synthetic plastics materials, for instance relatively thin layers of closed cell foam sheet. The side wall 21 may be formed integrally with the top plate 20, or may be a separate component that is bonded to the perimeter of the top plate 20, as it is to the perimeter of the baseplate 10. The side wall 21 is sufficiently flexible to permit limited movement of the top plate 20 relative to the baseplate 10, in the manner described below.

As shown in FIGS. 1 and 2, the top plate 20 has a continuous, planar surface and the baseplate 10 is formed with the transverse channels 11,12 that divide it into three portions. It will be appreciated that it is also possible for the baseplate 10 to have a continuous, planar surface and for channels or similar formations to be present in the top plate 20. Equally, both the top plate 20 and the baseplate 10 may have such formations.

As can be seen most clearly in FIG. 3, in which the top plate 20 is shown partly cut away, the top plate 20 and baseplate 10 are coupled together by a plurality of coupling elements 30. The coupling elements 30 are cylindrical components that are fixed to the underside of the top plate 20 and to the upper surface of the baseplate 10. Typically, the coupling elements 30 will be made of a resilient foam material. FIG. 2 shows coupling elements 30 upstanding from each of the three portions of the baseplate 10, ie the forefoot, midfoot and heel. In most embodiments of the present invention, the midsole is divided into at least forefoot and heel portions, and coupling elements are present in those regions of the midsole. Coupling elements may also be present in the midfoot region.

The effect of the coupling elements 30 is to connect the top plate 20 to the baseplate 10, but in such a manner that slight displacement of the top plate 20 is possible, relative to the base plate 10 and parallel to the plane of the midsole 1. According to the invention, there is less resistance to such displacement in one direction than in the reverse direction. Thus, displacement of the top plate 20 relative to the baseplate 10 may be brought about more readily by a force applied in one direction, typically but not necessarily by a force acting along an axis parallel to the longitudinal axis of the midsole 1, than by a force applied in the reverse direction. In the embodiment of FIGS. 1 to 3, this effect is brought about by virtue of the fact that the force required to widen the channels 11,12 in the baseplate 10 is less than the force required to compress those channels 11,12.

In many embodiments of the invention, coupling elements 30 disposed in the forefoot and heel regions of the midsole 1 are arranged to facilitate displacement of the top plate 20 in opposite directions relative to the base plate 10. For instance, the coupling elements 30 in the heel region may be arranged to permit displacement of the top plate 20 forwards (ie in the direction of motion of the wearer of a shoe incorporating the midsole 1) and the coupling elements 30 in the forefoot region may be arranged to permit displacement of the top plate backwards relative to the baseplate 10. Such preferred relative movement can be achieved by various means, for instance by the use of two or more different materials or by non-symmetrical shaping of the coupling elements 30.

The embodiments illustrated in FIGS. 4 to 12 incorporate different forms of coupling element that themselves provide for the displacement of the top plate of the midsole relative to the baseplate, with less resistance to displacement in one direction than in the reverse direction.

Figure 4:
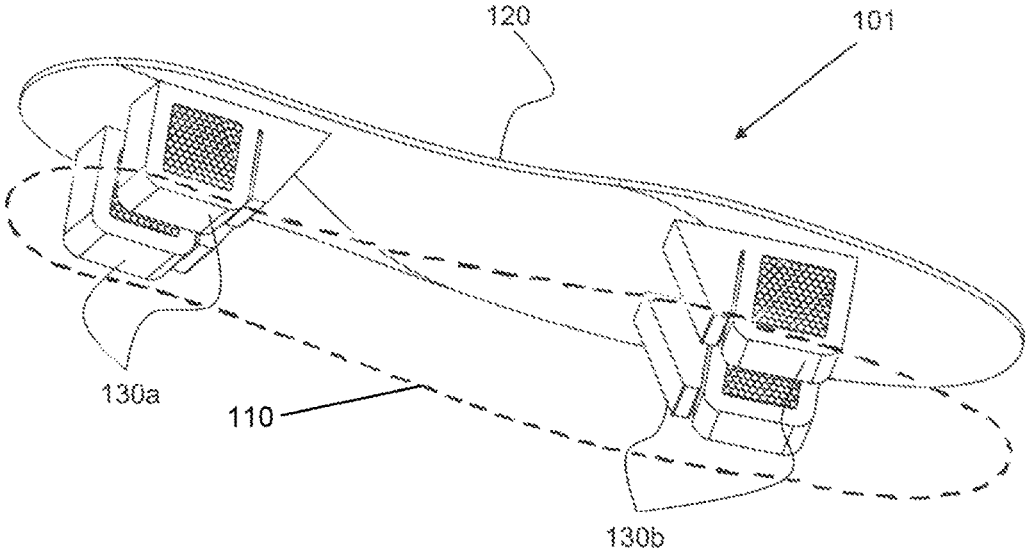
FIG. 4 is perspective view from below, with baseplate omitted, of a second embodiment of a midsole according to the invention.
Figure 6:
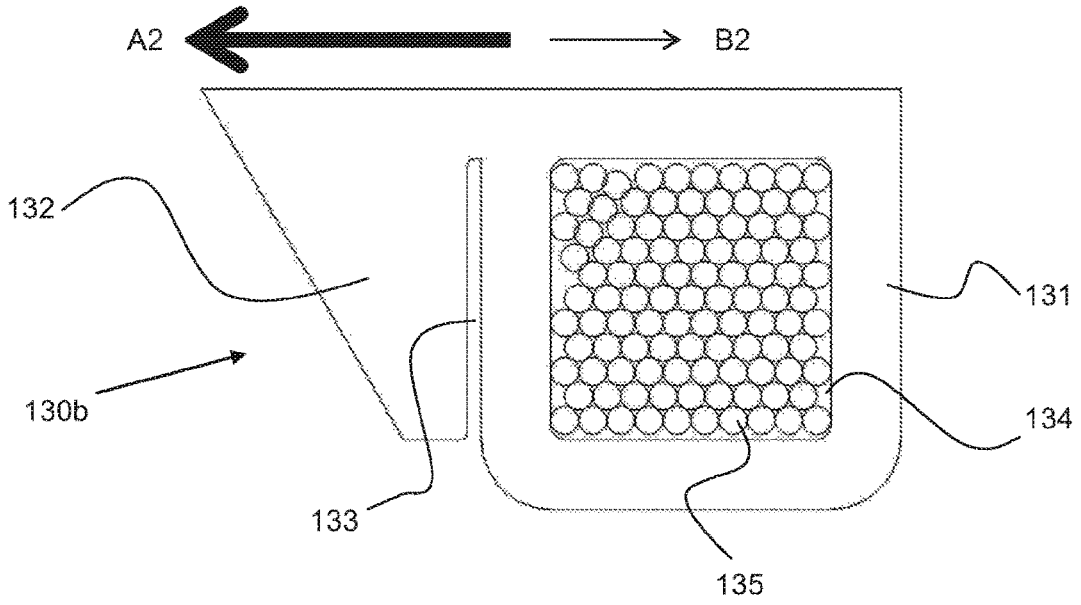
FIG. 6 is a side view of another coupling element forming part of the midsole of FIG. 4.
Figure 5:
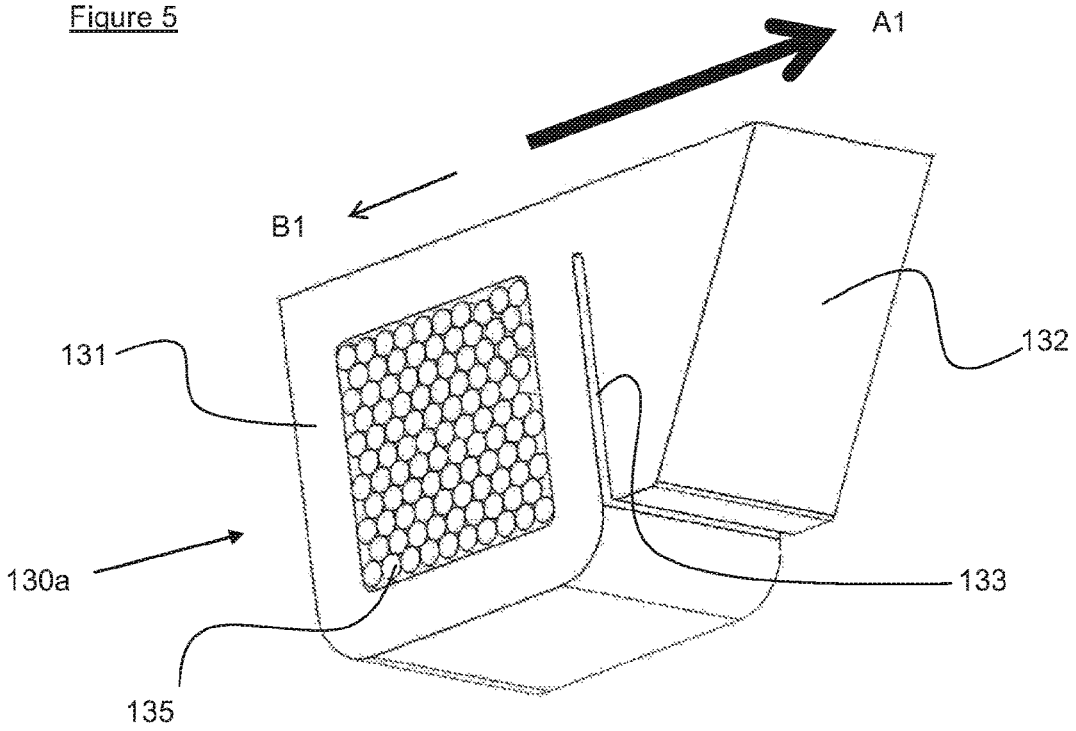
FIG. 5 is a perspective view from the side and below of a coupling element forming part of the midsole of FIG. 4.

Referring now to FIGS. 4 to 6, a second embodiment of a midsole according to the invention is generally designated 101 and includes coupling elements of the form shown in detail in FIGS. 5 and 6. For greater clarity, the coupling elements are shown in those Figures on somewhat exaggerated vertical scale.

In FIG. 4, the baseplate 110 of the midsole 101 is shown in phantom. This embodiment 101 incorporates a planar top plate 120, the underside of which carries a pair of coupling elements, 130 *a*,130 *b* respectively, at each of the heel and forefoot regions of the midsole 101. The coupling elements 130 *a*,130 *b* are bonded to the underside of the top plate 120 and to the upper surface of the baseplate 110.

The four coupling elements 130*a*,130*b* are identical, and are shown in greater detail in FIGS. 5 and 6, but the coupling elements 130*a* at the heel and the coupling elements 130*b* at the forefoot are mounted in opposite configurations, as can be seen from FIG. 4. FIG. 5 shows a perspective view of a heel coupling element 130*a*, and FIG. 6 is a side view of a forefoot coupling element 130*b*.

Each coupling element 130*a*,130*b* comprises a unitary block of elastomeric material, which is of uniform cross-section and comprises a generally square main body 131 and a generally triangular or trapezoidal stop portion 132. The main body 131 and stop portion 132 are separated by a narrow gap 133 that extends along most of one side of the main body 131, such that the main body 131 and the stop portion 132 have juxtaposed surfaces that are closely spaced apart. The main body 131 and stop portion 132 are joined at their upper parts, above the upper end of the gap 133.

The main body 131 has a generally square central opening 134 that extends fully through the main body 131. Each opening 134 is packed with tubes or rods 135. Typically the tubes or rods 135 are of compressible or elastomeric material, and are packed sufficiently densely within the opening 134 that they substantially fill the opening 134 and are retained within it.

The construction of the coupling elements 130*a*,130*b* is such that they provide considerably less resistance to displacement of the top plate 120 relative to the baseplate in the direction of the arrows "A1" and "A2", in FIGS. 5 and 6 respectively, than in the direction of arrows "B1" and "B2".

In relation to the coupling elements 130*a* at the heel of the midsole 101, movement of the top plate 120 in the forwards direction (FIG. 5, arrow "A1") is permitted more freely than movement in the reverse direction (FIG. 5, arrow "B1"). This is significant in the case of, for instance, a midsole 101 incorporated into a running shoe. The foot of a runner will typically strike the ground at the heel. The impulse in the direction of travel (change of linear horizontal momentum) experienced by the wearer of the shoe at each heel strike is the product of the average force and duration of impact. By permitting the top plate 120 to move slightly forwards when the heel strikes the ground, the duration of the impact is prolonged, and hence the horizontal force experienced by the runner in the direction opposite to the direction of travel is reduced. This decreases the risk of acute or chronic injury, as well as reducing fatigue and potentially leading to improved athletic performance.

Movement of the top plate 120 in the opposite direction relative to the baseplate (ie in the direction of arrow "B1" in FIG. 5) is inhibited by the stop portion 132 of the coupling element 130*a*. Such motion causes the gap 133 to close, and the juxtaposed surfaces of the main body 131 and stop portion 132 to impact upon each other.

The coupling elements 130*b* at the forefoot region of the midsole 101 provide a similar effect during toe-off, at the commencement of a stride. In this case, however, the runner presses against the ground to propel himself forwards, and the effect of the coupling elements 130*b* is to permit displacement of the top plate 120 backwards (ie in the direction of arrow "A2" in FIG. 6). Again, this prolongs the duration of the action, reducing the force experienced by the runner. Movement of the top plate 120 in the opposite direction (arrow "B2") is inhibited in the same manner as described above in relation to heel strike, ie by closing of the gap 133 and impact of the main body 131 on the stop portion 132.

In addition to the effect of the coupling element 130*a* in permitting movement of the top plate 120 relative to the baseplate, the coupling elements 130*a*,130*b* provide for cushioning in the manner of a conventional running shoe midsole construction. As the foot hits the ground, as well as the deformation of the coupling element 130*a* that permits forwards movement of the top plate 120, compressive forces are applied to the coupling element 130*a*. These forces cause the tubes or rods 135 to be pressed closer together and to reduce in diameter. The tubes or rods 135 may roll over each other in order to accommodate the forces applied to them. The coupling elements 130*a* thus absorb some of the forces of the impact of the runner's heel on the ground. The coupling elements 130*b* at the forefoot region of the midsole 101 undergo similar compression during the toe-off phase of the runner's stride.

The arrangement of coupling elements 130*a*,130*b* described above is appropriate for a shoe worn by a runner whose gait involves landing on the heel region of the foot (a "heelstriker"). It will be appreciated that for a runner whose running style involves landing on another part of the foot, eg the forefoot, it may be more appropriate for coupling elements at that part of the foot to have the orientation of the coupling elements 130*a*.

It will be appreciated that, whilst FIG. 4 shows a midsole 101 with the baseplate omitted, a similar arrangement of coupling elements 130*a*,130*b* could be mounted directly on the undersurface of the outsole of a shoe (ie in FIG. 4 the component 120 could represent that undersurface). In such a case, the coupling elements 130*a*,130*b* are disposed, in use, between the outsole and the ground, and the shear-reducing relative movement is between the outsole and the ground.

Likewise, similarly modified forms of the first, third and fourth embodiments are possible. Thus, referring again to FIGS. 1 to 3, the baseplate 10 with channels 11,12 may be the undersurface of an outsole. Alternatively, the baseplate 10 may be omitted altogether, in which case the coupling elements 30 will be in direct contact with the ground. In this case, however, the structure of the coupling elements 30 needs to be such that they provide greater resistance to displacement of the overlying components in one direction than in the reverse direction. To achieve that, the coupling elements may not have the form of simple cylinders of a single material, as depicted in FIGS. 2 and 3, but may instead have a geometrical shape that confers upon the coupling elements 30 different bending and stiffness characteristics in different directions, and/or the coupling elements may have a composite structure, different regions of the coupling elements 30 being formed in different materials in order to confer upon the coupling elements 30 the required directionality in their bending characteristics.

Figure 7:
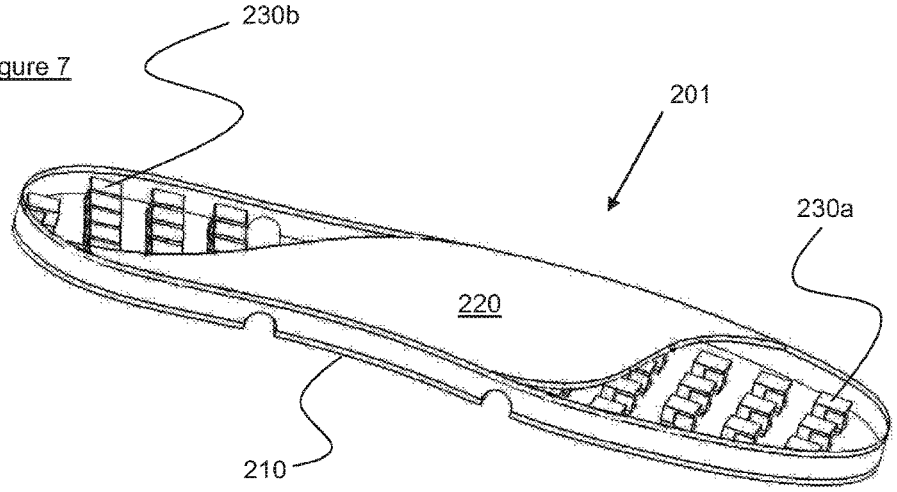
FIG. 7 is a perspective view of a third embodiment of a midsole according to the invention, partially cut away to reveal coupling elements within the midsole.
Figure 8:
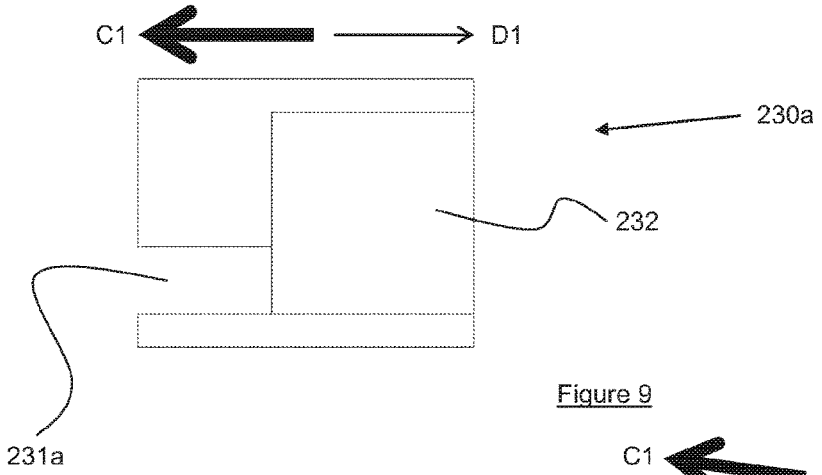
FIG. 8 is a side view of a coupling element forming part of the midsole of FIG. 7.
Figure 9:
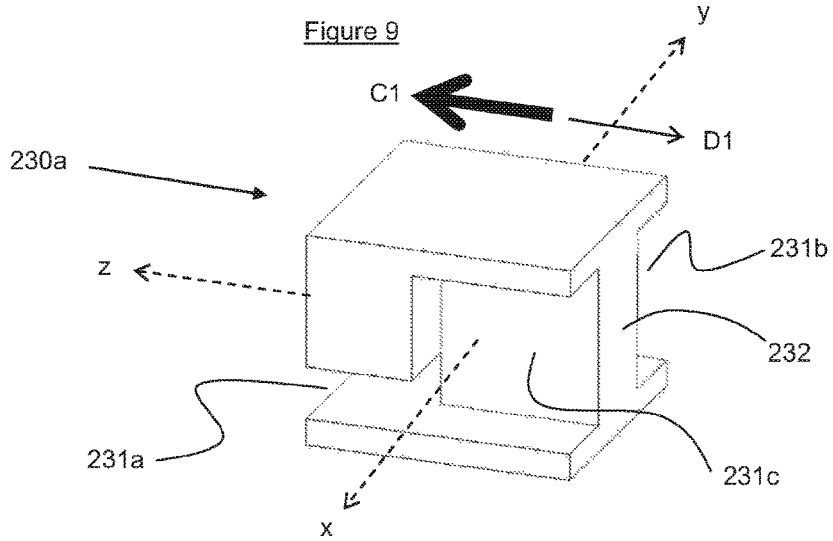
FIG. 9 is a perspective view of the coupling element of FIG. 8.

Turning now to FIGS. 7 to 9, a third embodiment of a midsole according to the invention is generally designated 201 and comprises coupling elements of the form shown in FIGS. 8 and 9.

As can be seen in FIG. 7, in which the planar top plate 220 is partially cut away, a plurality of coupling elements 230*a*,230*b* are bonded to the underside of the top plate 220 and to the upper surface of the baseplate 210, in the forefoot (coupling elements 230*a*) and heel (coupling elements 230*b*) regions, as for the first specific embodiment of the invention.

The coupling elements 230*a*,230*b* are identical and are arranged in regular arrays, as can be seen in FIG. 7. However, other patterns or arrangements of the coupling elements 230*a*,230*b* are possible, to confer different mechanical properties beneficial to the wearer.

The coupling elements at the forefoot 230*a* and the heel 230*b* are mounted in opposite configurations, as described for the first specific embodiment of the invention.

FIGS. 8 and 9 show a forefoot coupling element 230*a* in greater detail. FIG. 8 shows a side view of the forefoot coupling element 230*a*, and FIG. 9 shows a perspective view from above and one side.

Each coupling element 230*a*,230*b* consists of a generally cuboidal block of elastomeric material, with three cut away regions 231*a*,231*b*,231*c*, which define a pillar portion 232. The cut away regions 231*a*,231*b*,231*c* allow the structure to partially and resiliently collapse/deform. Coupling element 230*a* (FIG. 9) is able to partially and resiliently collapse/deform in directions "x", "y" and "z". By partially and resiliently collapse/deform is meant that the cuboidal block may be compressed or deformed under pressure in those directions, and will return to its original configuration when the pressure is removed.

The coupling elements 230*a*,230*b* are generally equally deformable in the "x" and "y" directions, ie transverse to the longitudinal axis of the midsole 301. However, the construction of the coupling elements 230*a*,230*b* is such that, in the "z" direction, they provide considerably less resistance to displacement of the top plate 220 relative to the base plate 210 in the direction of the arrows "C1", in FIGS. 8 and 9, than in the direction of arrows "D1".

Movement of the top plate 220 in the opposite direction relative to the base plate 210 (ie in the direction of arrows "D1" in FIGS. 8 and 9) is inhibited by the pillar portion 232 of the coupling elements 230*a*,230*b*, which prevents its partial collapse by providing an uninterrupted support which extends from top to bottom of the coupling elements 230*a*, 230*b*.

The coupling elements 230*a*,230*b* thus act in a similar manner to the coupling elements 130*a*,130*b* of the first specific embodiment of the invention, prolonging the duration of the heelstrike and toe-off actions, and so reducing the force experienced by a runner, as for the first embodiment.

As noted above, modified forms of the third embodiment are possible, in which the baseplate 210 is the ground-contacting surface of an outsole, or is omitted so that the coupling elements 230 are in direct contact with the ground.

Figure 10:
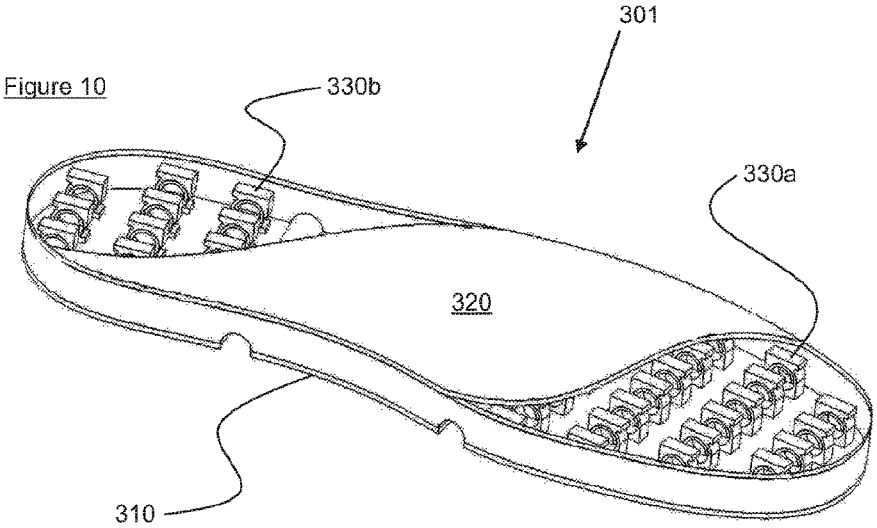
FIG. 10 is a view similar to FIG. 7, of a fourth embodiment of a midsole according to the invention.
Figure 11:
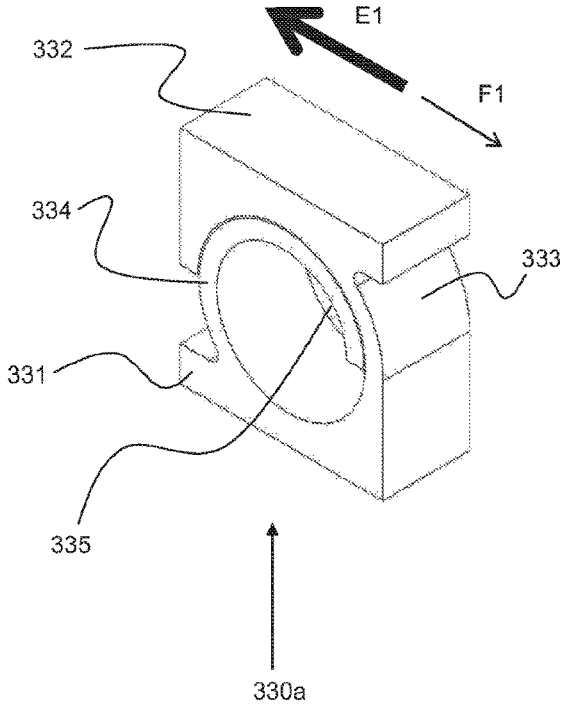
FIG. 11 is a perspective view, from above and one side, of a coupling element forming part of the midsole of FIG. 10.
Figure 12:
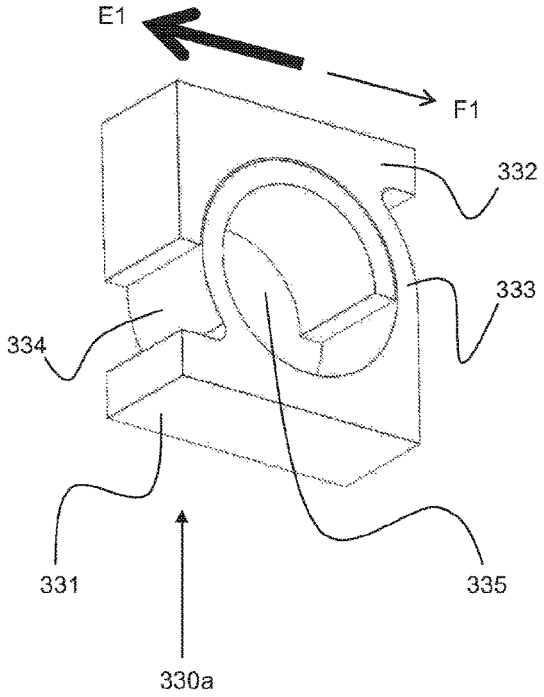
FIG. 12 is a further perspective view, from below and one side, of the coupling element of FIG. 11.

Finally, FIGS. 10 to 12 illustrate a shear-reducing midsole according to a fourth embodiment of the invention. The midsole is generally designated 301 and comprises coupling elements of the form shown in FIGS. 11 and 12.

As can be seen in FIG. 10, in which the planar top plate 320 is partially cut away, a plurality of coupling elements 330*a*,330*b* are bonded to the underside of the top plate 320 and to the upper surface of the baseplate 310, in the forefoot (coupling elements 330*a*) and heel (coupling elements 330*b*) regions, as for the first and second specific embodiments of the invention.

The coupling elements 330*a*,330*b* are identical and are arranged in regular arrays, as can be seen in FIG. 10. Again, other patterns or arrangements of the coupling elements 330*a*,330*b* are possible, to confer different mechanical properties beneficial to the wearer.

The coupling elements at the forefoot 330*a* and the heel 330*b* are mounted in opposite configurations, as for the first and second specific embodiments of the invention.

FIGS. 11 and 12 show a forefoot coupling element 330*a* in greater detail. FIG. 11 shows a perspective view from above and one side of the forefoot coupling element 330*a*, and FIG. 12 shows a perspective view from below and one side.

Each coupling element 330*a*,330*b* is injection-moulded in rigid plastics material, and is of generally square extent in side view, and of uniform cross-section.

The block has a base part 331 that is affixed to the baseplate 310 and a top part 332 that is affixed to the top plate 320. The base part 331 and the top part 332 are connected by a somewhat flexible upstand 333, at the right hand (as viewed in FIGS. 11 and 12) side of the coupling element 330*a*. The underside of the top part 332 is curved and, together with the internal side of the upstand 333 and the upper surface of the base part 331, forms a generally circular opening 335.

At the left hand side (as viewed in FIGS. 11 and 12) of the coupling element 330*a*, an arcuate, generally part-circular, spring element 334 extends upwardly from the base part 331 and follows the correspondingly-shaped curved undersurface of the top part 332. Overall, the spring element 334 subtends approximately 250° of arc, such that it terminates at a position adjacent the approximate mid-point of the upstand 333.

The structure of the coupling element 330*a* means that there is considerably less resistance to displacement of the top plate 320 relative to the baseplate 310 in the direction of the arrows "E1" in FIGS. 11 and 12, than in the direction of arrows "F1".

Backwards pressure applied to the top plate 320 of the midsole 301, as occurs during the toe-off phase of a runner's stride, results in a compressive force upon the coupling element 330*a*, which is accommodated by resilient deformation of the spring element 334, the tip of the spring element 334 being displaced downwardly, effectively reducing the diameter of the generally circular opening 335. It will also be appreciated that a compressive force applied vertically to the coupling element 330*a*, causing an effective reduction in the diameter of the opening 335, generates some displacement of the top part 332 in the direction of arrow "E1".

Forwards pressure applied to the heel part of the midsole, as during heelstrike, has a similar effect on the coupling elements 330*b* in that part of the midsole 301.

The spring element 334 is much less deformable in response to force applied in the direction of the arrows "F1", and hence displacement of the top plate 320 relative to the baseplate 310 of the midsole 301 in that direction (ie backwards at the heel portion of the midsole, and forwards at the forefoot region) is more strongly resisted.

Again, modified forms of the fourth embodiment are possible, in which the baseplate 310 is the ground-contacting surface of an outsole, or is omitted so that the coupling elements 330 are in direct contact with the ground.

The invention claimed is:

1. An item of footwear including a sole assembly that comprises a top plate and a baseplate;

one or more shear force-reducing coupling elements disposed between the top plate and the baseplate, each coupling element comprising a deformable main body portion extending from the top plate to the baseplate to provide cushioning and to permit limited displacement, in a plane parallel to the baseplate, of the top plate relative to the baseplate, and wherein each coupling element further comprises a stop portion, spaced from one of the top plate and baseplate, to inhibit deformation of said main body in one direction and thereby provide less resistance to said displacement of the top plate relative to the baseplate in a first direction than in a second, reverse direction.

2. An item of footwear as claimed in claim 1, wherein the one or more coupling elements are incorporated into a midsole that comprises the top plate and the baseplate that lie adjacent an insole and an outsole respectively.

3. An item of footwear as claimed in claim 2, wherein the top plate and the baseplate of the midsole are sheets of synthetic plastics material.

4. An item of footwear as claimed in claim 3, wherein the sheets are of foam material or bonded non-woven material.

5. An item of footwear as claimed in claim 2, wherein the top plate and the baseplate members of the midsole have thicknesses of between 2 mm and 5 mm.

6. An item of footwear as claimed in claim 2, wherein the midsole has an overall thickness of between 3 mm and 20 mm, or between 3 mm and 15 mm, or between 5 mm and 12 mm.

7. An item of footwear as claimed in claim 1, which is a shoe.

8. An item of footwear as claimed in claim 2, wherein the top plate and the baseplate are spaced apart and connected by said one or more coupling elements, the one or more coupling elements being adapted to permit limited displacement, in a plane parallel to the ground, of the top plate relative to the base plate, and wherein the coupling elements provide less resistance to displacement of top plate in a first direction than in a second, reverse direction.

9. An item of footwear as claimed in claim 1, wherein the main body and stop portion of the one or more coupling elements are joined at upper parts of the main body and stop portion.

10. An item of footwear as claimed in claim 1, wherein all the coupling elements are arranged in such a way that they favour displacement in the same direction.

11. An item of footwear as claimed in claim 1, wherein coupling elements are disposed in different regions and the coupling elements in different regions are configured to permit movement of the top plate relative to the baseplate in different directions.

12. An item of footwear as claimed in claim 11, wherein coupling elements are arranged at the heel portion and at the forefoot (toe) portion, the coupling elements at the heel portion being configured to permit movement forwards, and the coupling elements at the forefoot portion being configured to permit backwards displacement of the top plate relative to the baseplate.

13. An item of footwear as claimed in claim 1, wherein coupling elements are arranged to permit lateral displacement of the top plate relative to the baseplate.

14. An item of footwear as claimed claim 1, wherein the coupling elements comprise blocks of rubber or other elastomeric material.

15. An item of footwear as claimed in claim 14, wherein the blocks deform more readily in one direction than in the opposite direction as a consequence of the shape of the blocks.

16. An item of footwear as claimed in claim 14, wherein the blocks deform more readily in one direction than in the opposite direction as a result of the interaction of a block with another component that inhibits deformation of the block in one direction.

17. An item of footwear as claimed in claim 16, wherein said component is formed integrally with the block.

18. An item of footwear as claimed in claim 1, wherein the coupling elements comprise inelastic materials configured in such a way that they exhibit resilient deformation.

19. An item of footwear as claimed in claim 18, wherein the coupling element incorporates a spring-like member that is adapted to deform to a greater extent in response to a force applied in one direction than to a force applied in the opposite direction.

20. An item of footwear as claimed in claim 7, which is a running shoe.

21. A midsole for an article of footwear, the midsole comprising a top plate and a baseplate that lie adjacent an insole and an outsole respectively, the top plate and the baseplate being spaced apart and connected by one or more coupling elements, the one or more coupling elements each comprising a deformable main body portion extending from the top plate to the baseplate to provide cushioning and to permit limited displacement, in a plane parallel to the baseplate, of the top plate relative to the baseplate, and wherein the coupling elements each further comprise a stop portion, spaced from one of the top plate and the baseplate, to inhibit deformation of said main body in one direction and thereby provide less resistance to displacement of the top plate in a first direction than in a second, reverse direction.

* * * * *